US005233319A

United States Patent [19]

Mizan et al.

[11] Patent Number: 5,233,319

[45] Date of Patent: Aug. 3, 1993

[54] LOW-COST, LOW-NOISE, TEMPERATURE-STABLE, TUNABLE DIELECTRIC RESONATOR OSCILLATOR

[75] Inventors: Muhammad A. Mizan, Ocean; Raymond C. McGowan, Neptune, both of N.J.

[73] Assignee: The United States of America as represented by the Secretary of the Army, Washington, D.C.

[21] Appl. No.: 858,748

[22] Filed: Mar. 27, 1992

[51] Int. Cl.[5] ..... H01P 7/10

[52] U.S. Cl. ..... 333/219.1; 333/235; 331/96; 331/117 D

[58] Field of Search ..... 333/202, 219, 219.1, 333/235, 227, 229, 231, 232; 331/96, 99, 107 DP, 117 D, 177 V

[56] References Cited

U.S. PATENT DOCUMENTS

| | | | |
|---|---|---|---|
| 4,639,690 | 1/1987 | Lewis | 333/231 X |
| 4,780,691 | 10/1988 | Fiedziuszko | 333/235 X |
| 4,871,983 | 10/1989 | Graycar | 331/96 |
| 5,130,675 | 7/1992 | Sugawara | 331/99 X |

FOREIGN PATENT DOCUMENTS

| | | | |
|---|---|---|---|
| 0060201 | 2/1990 | Japan | 333/219.1 |

OTHER PUBLICATIONS

G. K. Montress and T. E. Parker, "Design Techniques for Achieving State-of-the Art Oscillator Performance", Proceedings of the 44th Annual Symposium on Frequency Control 1990, pp. 522-535, IEEE Catalog No. 90CH2818-3.

Mizan et al., "Temperature Stable, Low-Phase Noise 2 HGz Dielectric Resonator Oscillator", IEEE MTT-S Digest, LL-4, pp. 1183-1186, IEEE Catalog No. 91CH2870-4, Jun. 1991.

M. Mizan et al., "Ultra-Low Noise, 8.3 GHz Dielectric Resonator Oscillator", Proceedings of the 45th Annual Symposium on Frequency Control May 1991, pp. 693-699 IEEE Catalog No. 91CH2965-2.

M. Mizan et al., "Extremely Low-Phase Noise X-Band Field Effect Transistor Dielectric Resonator Oscillator", Jun. 1991 IEEE MTT-S Digest, AA-5, pp. 891-894 IEEE Catalog No. 91CH2870-4.

M. Mizan et al., "Determination of the Limiting Factors in the Absolute Phase Noise of an L-Band Dielectric Resonator Oscillator", Proceeding of the 45th Annual Symposium on Frequency Control, May 1991, pp. 687-692 IEEE Catalog No. 91CH2965-2.

*Primary Examiner*—Robert J. Pascal
*Assistant Examiner*—Seung Ham
*Attorney, Agent, or Firm*—Michael Zelenka; William H. Anderson

[57] ABSTRACT

A dielectric resonator oscillator having a resonant structure connected to an amplifier the output of which is fed back to the input of the resonant structure. The resonant structure includes a metal cavity in which a dielectric disk is centrally mounted by a low-loss dielectric post. A pair of microstrip transmission lines extend into the cavity to provide energy outputs and inputs. Dielectric and conductive tuning screws are mounted on the cavity walls. Electrical tuning is provided via a varactor diode whose bias is adjustable. The diode may be connected in series or parallel with the microstrip transmission line.

21 Claims, 3 Drawing Sheets

LOW-COST, LOW-NOISE, TEMPERATURE-STABLE, TUNABLE DIELECTRIC RESONATOR OSCILLATOR

GOVERNMENT INTEREST

The invention described herein may be manufactured, used, and licensed by or for the Government for governmental purposes without the payment to us of any royalty thereon.

BACKGROUND OF THE INVENTION

1. Field of the Invention

This invention relates to the field of microwaves More particularly, the invention relates to dielectric resonator oscillators for use as microwave frequency sources.

2. Description of the Prior Art

One of the most critical problems confronting designers of high-precision RF and microwave systems, such as compact radars, beacons, transponders, satellite communication systems, atmospheric profilers and electronic countermeasure receivers, has been the generation of high-frequency signals of extremely good spectral purity. Dielectric resonator oscillators (DROs), used in such equipment for microwave signal generation, have been shown to have extremely low-phase noise and high-temperature stability. Prior art DROs are described by G. K. Montress and T. E. Parker in "Design Techniques for Achieving State-of-the-Art Oscillator Performance", Proceedings of the 44th Annual Symposium on Frequency Control 1990, pp. 522–535, IEEE Catalog No. 90CH2818-3.

Typical DROs include a dielectric resonator, used as a frequency determining circuit element in a parallel feedback configuration with an amplifier. Feedback oscillators are of particular importance because they usually offer much better FM noise performance and frequency stability than achievable with conventional reflection oscillators. Additionally, dielectric resonators have found extensive use because they offer high efficiency and simple construction. However, although such prior art DROs have served the purpose, those concerned with their development have long recognized the need to further lower their cost, increase their temperature stability and improve their phase-noise performance. The present invention fulfills this need.

SUMMARY OF THE INVENTION

The general purpose of this invention is to provide low-cost resonant structures and DROs which embrace all of the advantages of similarly employed resonators and oscillators while possessing improved temperature stability and phase-noise performance. To attain this, the present invention contemplates a unique resonant structure arrangement with a resonator cavity of improved design and active devices having optimum performance characteristics.

More specifically, the resonant structure includes a cavity that has multiple resonant frequencies. The cavity has a cylindrical side wall, a flat top wall and a flat base. A dielectric member, whose operating frequency is different from those of the cavity modes, is suspended in the cavity. An input microstrip couples energy into the cavity and an output microstrip couples energy from the cavity. According to another aspect of the invention, the resonant structure is connected to an amplifier the output of which is fed back to the resonator to form an oscillator.

It is, therefore, an object of the invention to provide a DRO with relatively low phase noise.

Another object of the invention is the provision of a DRO having good high-temperature stability.

A further object of the invention is to provide a DRO that may be tuned either electrically or mechanically using simple, inexpensive resonator tuning devices.

BRIEF DESCRIPTION OF THE DRAWINGS

These and other objects, features, and details of the invention will become apparent in light of the ensuing detailed disclosure, and particularly in light of the drawings wherein.

DETAILED DESCRIPTION OF THE PREFERRED EMBODIMENTS

Figure 1:
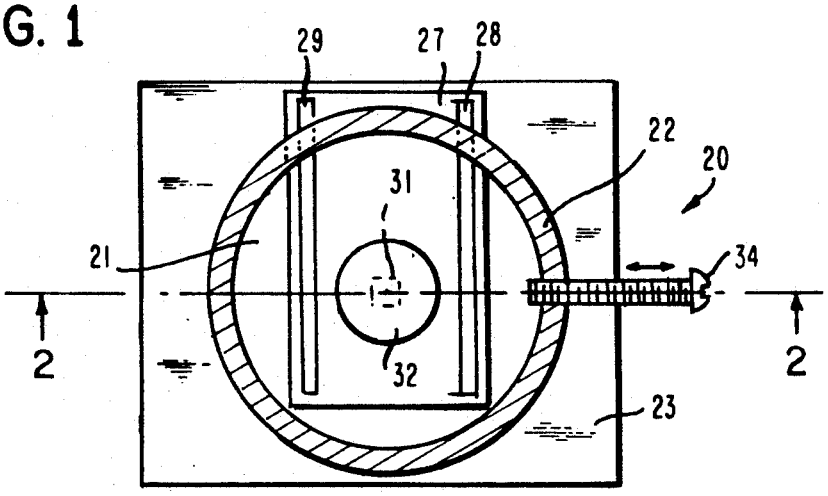
FIG. 1 is a cross-sectional plan view of a preferred embodiment of the resonant structure taken on the line 1—1 of FIG. 2 and looking in the direction of the arrows.
Figure 2:
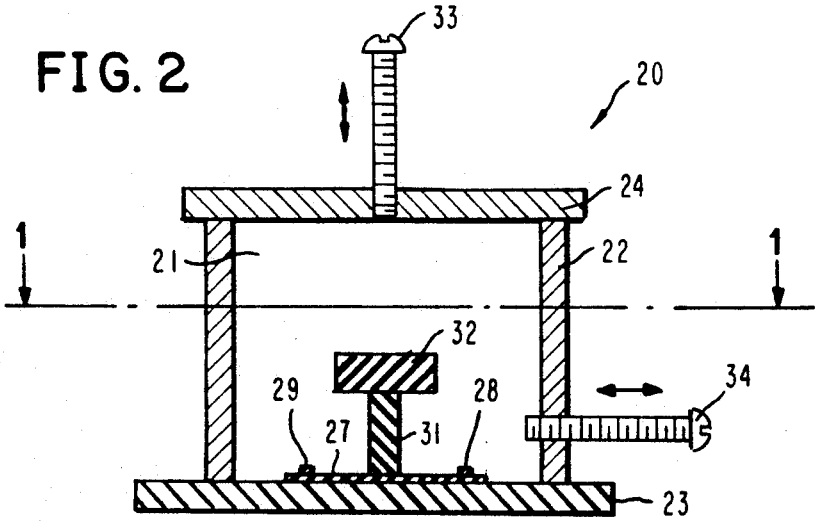
FIG. 2 is a cross-sectional elevation of the preferred embodiment of the resonant structure taken on the line 2—2 of FIG. 1 and looking in the direction of the arrows.

Referring now to FIGS. 1 and 2, there is shown a resonant structure 20 having a resonator cavity 21 formed by a metallic cylinder 22, a metallic base 23 and a metallic lid 24. An insulating circuit board 27, mounted on the upper surface of base 23, carries first and second open-ended microstrips 28, 29. Board 27 and microstrips 28, 29 extend into cavity 21 and have one end accessable to the exterior of cavity 21. A low-loss dielectric standoff post 31 mounts a cylindrical dielectric disk 32 near the center of cavity 21.

A pair of tuning screws 33 and 34 are mounted for selective movement into cavity 21. Screw 33 is electrically conductive and is mounted on lid 24 for verticle movement along the axis of cylinder 22. Screw 34, which is an electrically nonconductive dielectric, is mounted on cylinder 22 for radial movement in a horizontal plane that is located midway between disk 32 and base 23.

With tuning screws 33, 34 withdrawn, cavity 21 will have a dimension of cavity 21, and the composition and dimensions of disk center resonant frequency that is substantially a function of the 32. Cavity 21 may be tuned to other frequencies by advancing screws 33, 34 into cavity 21. Moving conductive screw 33 into cavity 21 causes cavity 21 to be resonant at a higher center frequency. Moving dielectric screw 34 into cavity 21 lowers the center frequency.

Electromagnetic energy can be coupled to cavity 21 at the resonant frequency via either one of the microstrips 28, 29. Likewise, energy at the resonant frequency can be extracted from cavity 21 via either one of the microstrips 28, 29.

The demensions of cavity 21 are preferably chosen such that the natural resonant frequency of dielectric disk 32 is unperturbed when placed inside metal cavity 21. The preferred diamater of cavity 21 is roughly three times the diameter of disk 32, and the preferred height of cavity 21 is about five times the thickness of disk 32. Dielectric materials for fabricating disk 32 are commercially available with temperature coefficients of 0 ppm/K such that there will be no frequency change with changes in temperature.

The preferred diameter of the post 31 is about one-half the diameter of disk 32. Post 31 is preferably fabricated from a low-loss, low-dielectric-constant material such as Eco-foam, alumina or boron nitride. Disk 32 is preferably positioned one-quarter wavelength away from open-ended microstrips 28, 29 to minimize the insertion loss. In this configuration, resonant structure 20 operates in the TE01 delta mode. It is noted that other configurations will be apparent to those skilled in these arts.

Figure 3:
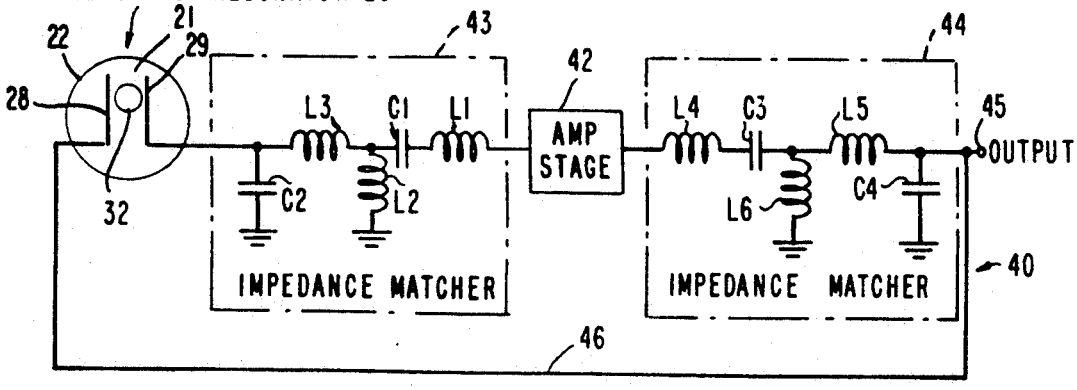
FIG. 3 is a schematic circuit diagram showing a preferred embodiment of the DRO.

FIG. 3 shows a schematic circuit diagram of a feedback-loop oscillator 40 using resonant structure 20 to establish the operating frequency. Output mirostrip 29 is connected to an amplifier 42 by an impedance matching network 43 having lumped capacitors C1, C2 and inductors L1-L3. The output of amplifier 42 is connected to output terminal 45 via an impedance matching network 44 having lumped capacitors C3, C4 and inductors L4-L6. Output terminal 45 is connected to input microstrip 28 via a feedback conductor 46. Impedance matching networks 43, 44, schematically shown in FIG. 3 with lumped elements, i.e. lumped capacitors C1-C4 and inductors L1-L6, are preferably implemented using conventional impedance-matching transmission lines.

Oscillator 40 is ideally suited for use as a stable, tunable, low-noise microwave frequency source from L- to k-Band (2-30 GHz). Amplifier 42 may be fabricated using commercially available bipolar junction transistors (BJT) or field effect transistors (FET) depending on the operating frequency. For example, NE64408 BJT may be used for L-band amplifier design and Fujitsu FLK052WG FET may be used for X-band amplifier design. Also, two amplifiers may be cascaded to overcome dielectric resonant losses and to provide excess loop gain in oscillator 40.

Figure 6:
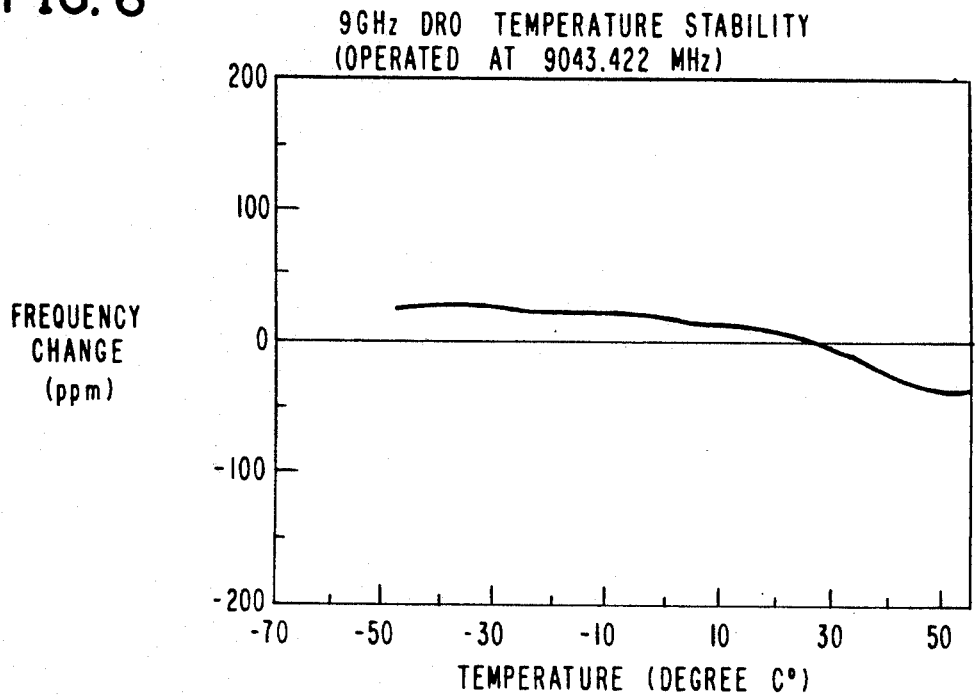
FIGS. 6 and 7 show graphs of test results useful in understanding the present invention.
Figure 7:
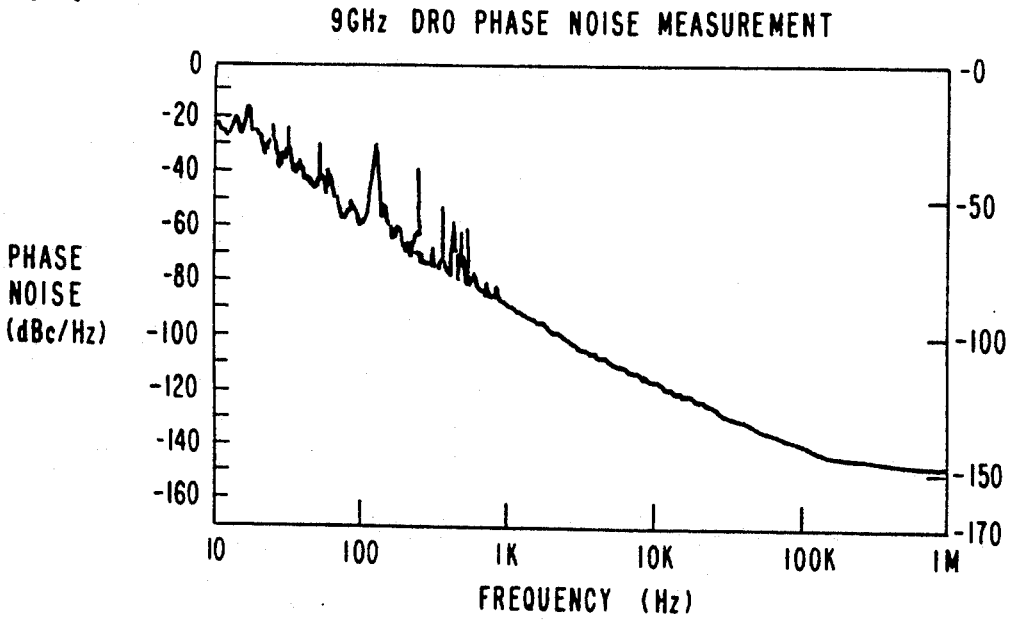

Using the circuit configuration of FIG. 3, a DRO was fabricated and tested. The test results are shown in FIGS. 6 and 7. For the test device, the measured temperature stability over −50 C. to +50 C., as seen in FIG. 6, was about 5 times better than the best known industry devices and the phase noise, shown in FIG. 7, was about 5-15 dBc/Hz better than commercially available DROs. More specific test results may be found in the following publication authored by the present inventors and others. Mizan et al.. "Temperature Stable, Low-Phase Noise 2 HGz Dielectric Resonator Oscillator", IEEE MTT-S DIGEST, LL-4, pp. 1183-1186, IEEE Catalog No. 91CH2870-4, June 1991, which is incorporated herein by reference. The following publications, which are also authored by the present inventors and provide further related details, are also incorporated by reference: M. Mizan et al., "Ultra-Low Noise, 8.3 GHz Dielectric Resonator Oscillator", Proceedings of the 45th Annual Symposium on Frequency Control May 1991, pp. 693-699 IEEE Catalog No. 91CH2965-2; M. Mizan et al, "Extremely Low-Phase Noise X-Band Field Effect Transistor Dielectric Resonator Oscillator", June 1991 IEEE MTT-S Digest, AA-5, pp. 891-894 IEEE Catalog No. 91CH2870-4; M. Mizan et al, "Determination of the Limiting Factors in the Absolute Phase Noise of an L-Band Dielectric Resonator Oscillator", Proceeding of the 45th Annual Symposium on Frequency Control, May 1991, pp. 687-692 IEEE Catalog No. 91CH2965-2.

Figure 4A:
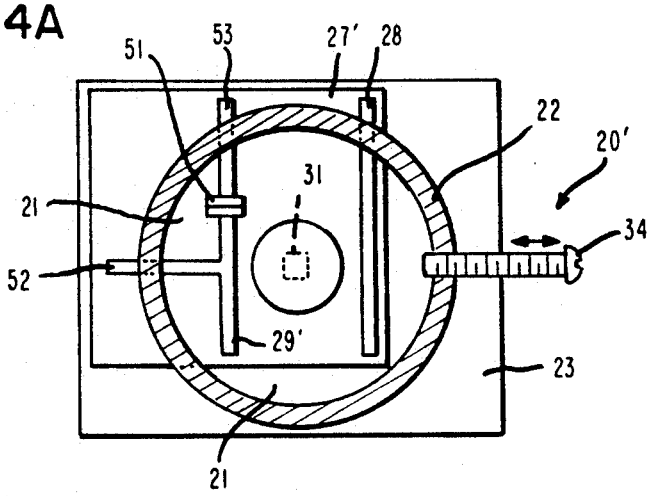
FIG. 4A is a sectional plan view similar to the view of FIG. 1 of a modification of the invention.
Figure 4B:
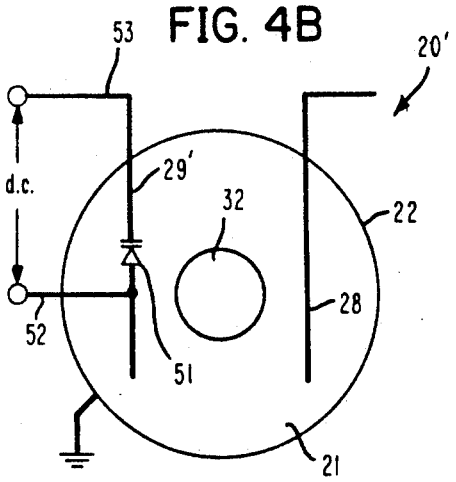
FIG. 4B is a schematic diagram of the circuit shown in FIG. 4A.

FIGS. 4A, 4B illustrate a resonant structure 20' having provision for electrical tuning. Structure 20' is similar to structure 20 of FIG. 1 with a few exceptions. First, a modified microstrip 29' replaces microstrip 29. Modified microstrip 29' includes a series-connected varactor diode 51 that will perturb the tuning of cavity 21 when the diode 51 is biased with a d.c. voltage. Second, a conductor 52, connected to microstrip 29' on one side of diode 51, is added and extends to the exterior of cavity 21 on a modified circuit board 27' that is larger than board 27. The appropriate d.c. biasing voltage is applied to diode 51 via conductor 52 and an end portion 53 of microstrip 29'. When biased, diode 51 will introduce a series capacitance into microstrip 29'. The value of the capacitance introduced by diode 51 is adjusted by adjusting the value of the d.c. bias voltage. The resonant frequency of resonant structure 20' is electrically varied by adjusting the d.c. bias on diode 51.

Figure 5B:
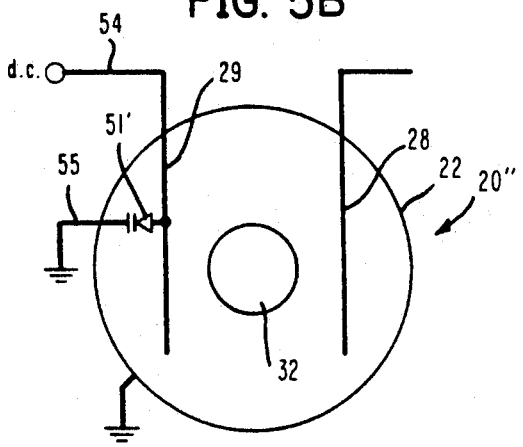
FIG. 5B is a schematic diagram of the circuit shown in FIG. 5A.
Figure 5A:
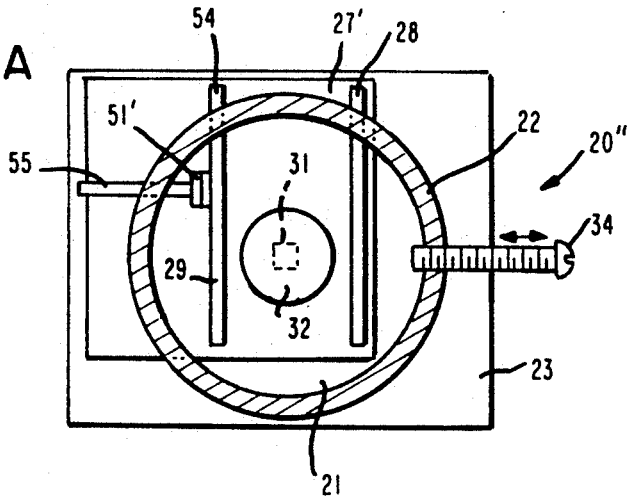
FIG. 5A is a sectional plan view similar to the views of FIGS. 1 and 4A of another modification of the invention.

FIGS. 5A, 5B illustrate another variation of an electrically tuned resonant structure 20" that is similar to structure 20 with an exception that a varactor diode 51' is connected in parallel with microstrip 29. Varactor diode 51' has one side connected to microstrip 29 and the other side connected to a grounded conductor 55. A d.c. bias voltage applied to an end portion 54 of microstrip 29 causes the microstrip 29 to be capacitively coupled to ground. In this regard, the capacitance will be a function of the magnitude of the d.c. bias on diode 51'. As such, the resonant frequency of structure 20" is electrically tuned by adjusting the d.c. bias on diode 51'.

It should be understood, of course, that the foregoing disclosure relates to preferred embodiments of the invention and that numerous modifications or alterations may be made therein without departing from the spirit and the scope of the invention as set forth in the appended claims.

What is claimed is:

1. A resonant structure comprising:

a resonant cavity having a substantially cylindrical side wall, a flat top wall, and a flat base;

a post having a first and second end, said first end of said post mounted to said flat base in said cavity;

a dielectric disk, resonant at a center frequency, mounted to said second end of said post, said disk mounted coaxially with said cylindrical side wall and substantially midway between said base and said top wall;

an insulating substrate mounted over said flat base;

an input microstrip for coupling energy into said cavity; and an output microstrip for removing energy at said center frequency from said cavity;

wherein said cylindrical side wall has a diameter that is at least three times greater than the diameter of said disk.

2. The structure of claim 1 wherein each said microstrip is an elongated conductor formed over said insulating substrate and wherein said input and output microstrips are located on either side of said post and parallel to each other separated at a distance greater than the diameter of said dielectric disk.

3. The structure of claim 1 further including tuning means couple to said cavity for adjusting the resonant frequency of said resonator.

4. The structure of claim 3 wherein said tuning means includes a conductive probe having first adjusting means for inserting said probe a selected distance into said cavity.

5. The structure of claim 4 wherein said conductive probe is a coaxial metal screw threaded in said top wall.

6. The structure of claim 4 wherein said tuning means includes a dielectric probe having a second adjusting means for inserting said probe a selected distance into said cavity.

7. The structure of claim 6 wherein said dielectric probe is a radially positioned screw threaded in said side wall.

8. The structure of claim 3 wherein said tuning means includes a varactor diode connected to one of said microstrips and conductor means for permitting a d.c. bias voltage to be applied to said diode.

9. The structure of claim 8 wherein said diode is connected in series with one of said conductive strips.

10. The structure of claim 8 wherein said diode is connected in parallel across one of said microstrips.

11. A dielectric resonator oscillator comprising:

a resonant cavity being substantially cylindrical in shape having a top wall and a base;

a post mounted in said cavity;

a resonant dielectric disk supported by said post such that said disk is located coaxially with said cavity and substantially midway between said base and said top wall;

an input microstrip extending into said cavity;

an output microstrip extending into said cavity; wherein said cylindrical resonant cavity has a diameter that is at least three times the diameter of said resonant dielectric disk; and an amplifier having an input connected to said output microstrip and an output connected to said input microstrip.

12. The oscillator of claim 11 wherein each said microstrip includes a conducting strip spaced above said base with a dielectric substrate.

13. The oscillator of claim 12 wherein each said conducting strip is a narrow, elongated conductor located on either side of said post and parallel to each other.

14. The oscillator of claim 13 further including tuning means couple to said cavity for adjusting the frequency of said oscillator.

15. The oscillator of claim 14 wherein said tuning means includes a conductive probe having first adjusting means for inserting said probe a selected distance into said cavity.

16. The oscillator of claim 15 wherein said conductive probe is a coaxial metal screw threaded in said top wall.

17. The oscillator of claim 15 wherein said tuning means includes a dielectric probe having a second adjusting means for inserting said probe a selected distance into said cavity.

18. The oscillator of claim 17 wherein said dielectric probe is a radially positioned screw threaded in said side wall.

19. The oscillator of claim 14 wherein said tuning means includes a varactor diode connected to one of said microstrips extending into said cavity and conductor means for permitting a d.c. bias voltage to be applied to said diode.

20. The oscillator of claim 19 wherein said diode is connected in series with one of said conductive strips.

21. The oscillator of claim 19 wherein said diode is connected to parallel across one of said microstrips extending into said cavity.

* * * * *